US009097124B2

(12) United States Patent
Dube et al.

(10) Patent No.: US 9,097,124 B2
(45) Date of Patent: Aug. 4, 2015

(54) GAS TURBINE ENGINE STATOR VANE ASSEMBLY WITH INNER SHROUD

(75) Inventors: David P. Dube, Saco, ME (US); Michael E. McMahon, Shapleigh, ME (US); Steven J. Feigleson, Falmouth, ME (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 656 days.

(21) Appl. No.: 13/356,721

(22) Filed: Jan. 24, 2012

(65) Prior Publication Data

US 2013/0189092 A1 Jul. 25, 2013

(51) Int. Cl.

| | |
|---|---|
| ***F03B 11/02*** | (2006.01) |
| ***F01D 9/04*** | (2006.01) |
| ***F01D 5/16*** | (2006.01) |
| ***F01D 11/12*** | (2006.01) |

(52) U.S. Cl.

CPC *F01D 9/042* (2013.01); *F01D 5/16* (2013.01); *F01D 11/122* (2013.01); *F05D 2260/96* (2013.01)

(58) Field of Classification Search

CPC ..... F01D 11/12; F01D 9/44; F01D 9/044; F01D 9/042; F01D 11/122; F01D 5/16; F05D 2260/96

USPC ..... 415/209.2, 209.3

See application file for complete search history.

(56) References Cited

U.S. PATENT DOCUMENTS

| | | | | |
|---|---|---|---|---|
| 4,195,396 | A | 4/1980 | Blazek | |
| 4,464,094 | A | 8/1984 | Gerken | |
| 5,248,240 | A | 9/1993 | Correia | |
| 5,399,069 | A * | 3/1995 | Marey et al. | 415/209.3 |
| 5,494,404 | A * | 2/1996 | Furseth et al. | 415/209.3 |
| 6,234,750 | B1 * | 5/2001 | Mielke et al. | 415/189 |
| 6,354,797 | B1 | 3/2002 | Heyward et al. | |
| 6,425,736 | B1 * | 7/2002 | McMahon et al. | 415/173.4 |
| 6,464,456 | B2 * | 10/2002 | Darolia et al. | 415/134 |
| 6,793,457 | B2 | 9/2004 | Caddell et al. | |
| 6,905,308 | B2 | 6/2005 | Hagle et al. | |
| 7,753,647 | B2 | 7/2010 | Giaimo et al. | |
| 7,819,627 | B2 * | 10/2010 | Walters | 416/90 R |
| 8,910,947 | B2 * | 12/2014 | Voisine et al. | 277/511 |
| 2007/0104574 | A1 * | 5/2007 | Ashley et al. | 415/209.3 |
| 2009/0324394 | A1 * | 12/2009 | Weaver | 415/173.7 |
| 2011/0142684 | A1 | 6/2011 | Campbell et al. | |

* cited by examiner

*Primary Examiner* — Dwayne J White
*Assistant Examiner* — Jason Fountain
(74) *Attorney, Agent, or Firm* — Carlson, Gaskey & Olds, P.C.

(57) ABSTRACT

A stator vane assembly includes a vane having an inner end. In one example, the vane is aluminum. An inner shroud has an aperture receiving the inner end. A flexible material secures the inner end to the inner shroud. The material has an inner surface opposite the vane providing a seal land in one example. The inner shroud provides an arcuate inner shroud segment, which is constructed either cast aluminum or stamped sheet steel. An inner shroud segment has an arcuate wall providing multiple apertures, for example. First and second flanges are integral with and extending radially inwardly from a concave side of the wall.

13 Claims, 4 Drawing Sheets

GAS TURBINE ENGINE STATOR VANE ASSEMBLY WITH INNER SHROUD

BACKGROUND

This disclosure relates to a gas turbine engine, and more particularly, a stator vane assembly and inner shroud.

One type of gas turbine engine includes a core supported by a fan case. The core rotationally drives a fan within the fan case. Multiple circumferentially arranged stator vanes are supported at an inlet. Stator vanes are also used at various stages of a compressor section of the core.

The stator vanes are supported, by an outer case, for example, in a manner to limit displacement of the vanes. The vanes are subjected to vibratory stresses by the supporting structure. That is, loads are transmitted through the outer case or other support structure to the stator vanes. Typically, the stator vanes are constructed from titanium, stainless steel or a high grade aluminum, such as a 2618 alloy, to withstand the stresses to which the stator vanes are subjected. Inner ends of the stator vanes are secured to an inner shroud. The inner shroud is typically forged and then machined, or molded from a composite material. Typically, the inner shroud is a unitary annular structure. The inner ends of the stator vanes may be brazed to the inner shroud, in which case a material such as titanium or stainless steel must be used for the vanes to withstand the vibratory stresses transmitted by the inner shroud to the inner ends of the stator vanes.

One type of front architecture supports the stator vanes relative to inner and outer shrouds using rubber grommets. A fastening strap is wrapped around the circumferential array of stator vanes to provide mechanical retention of the stator vanes with respect to the shrouds. The inner shroud is provided by a unitary annular structure in this configuration.

SUMMARY

A stator vane assembly includes a vane having an inner end. In one example, the vane is aluminum. An inner shroud has an aperture receiving the inner end. A flexible material secures the inner end to the inner shroud. The material has an inner surface opposite the vane providing a seal land in one example.

In a further embodiment of any of the above, a rotor includes a sealing structure engaging the seal land.

In a further embodiment of any of the above, the inner shroud is provided by multiple circumferentially arranged discrete inner shroud segments. A circumferential array of vanes each include inner ends supported by the inner shroud segments.

In a further embodiment of any of the above, the shroud segments are provided by one of a cast aluminum structure or a stamped sheet metal structure.

In a further embodiment of any of the above, the inner end includes at least one notch providing a portion received in the aperture in the inner shroud. A gap is provided between the inner end and the aperture with the material disposed in the gap and joining the inner end to the inner shroud.

In a further embodiment of any of the above, the entire inner end is spaced from the inner shroud.

In a further embodiment of any of the above, the flexible material is an elastomeric material.

In a further embodiment of any of the above, the elastomeric material is a silicone rubber.

In a further embodiment of any of the above, the inner shroud includes a wall providing the aperture receiving the inner end. First and second spaced apart flanges adjoin the wall and provide a cavity. The cavity is filled with the flexible material.

In a further embodiment of any of the above, the flexible material extends radially inwardly and proud of the first and second flanges.

In a further embodiment of any of the above, each vane includes an outer shroud integral with the vane.

In a further embodiment of any of the above, the outer shroud includes hooks mounted in an outer case.

In a further embodiment of any of the above, the rotor is provided in a compressor section.

The inner shroud provides an arcuate inner shroud segment, which is constructed either cast aluminum or stamped sheet steel. An inner shroud segment has an arcuate wall providing multiple apertures, for example. First and second flanges are integral with and extending radially inwardly from a concave side of the wall.

In a further embodiment of any of the above, the inner shroud segment is constructed from one of a cast aluminum or a stamped sheet steel.

A stator vane assembly includes an array of aluminum vanes that each include an inner end. An arcuate inner shroud segment has apertures that each receive a corresponding inner end. The inner shroud segment is constructed from one of a cast aluminum and a stamped sheet steel. A flexible material secures the inner ends to the inner shroud segment.

BRIEF DESCRIPTION OF THE DRAWINGS

The disclosure can be further understood by reference to the following detailed description when considered in connection with the accompanying drawings wherein.

DETAILED DESCRIPTION

Figure 1:
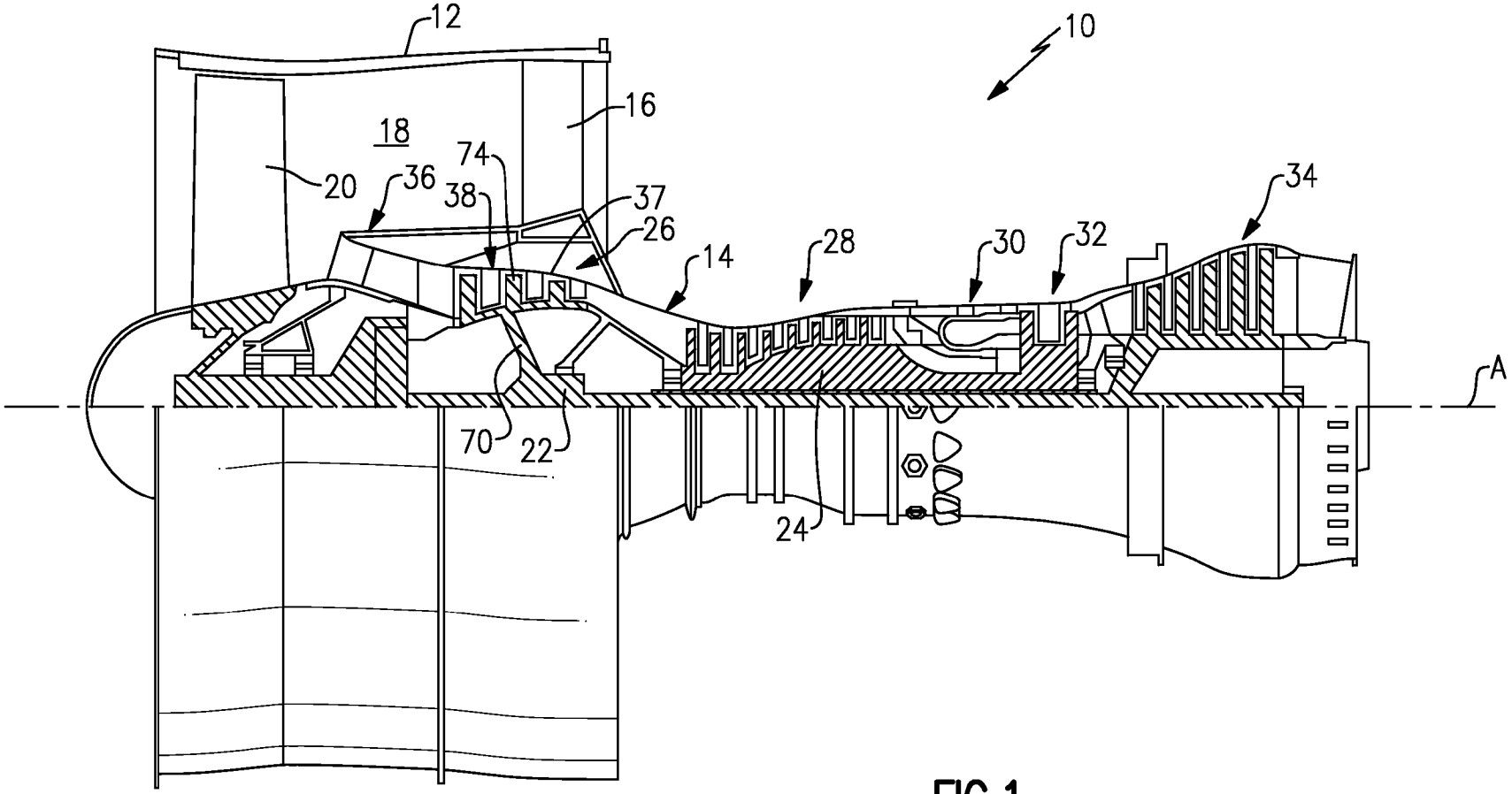
FIG. 1 is schematic view of an example gas turbine engine.

A gas turbine engine 10 is illustrated schematically in FIG. 1. The gas turbine engine 10 includes a fan case 12 supporting a core 14 via circumferentially arranged flow exit guide vanes 16. A bypass flow path 18 is provided between the fan case 12 and the core 14. A fan 20 is arranged within the fan case 12 and rotationally driven by the core 14.

The core 14 includes a low pressure spool 22 and a high pressure spool 24 independently rotatable about an axis A. Although a two spool arrangement is shown, it should be understood that any number of spools may be used, including three. The low pressure spool 22 rotationally drives a low pressure compressor section 26 and a low pressure turbine section 34. The high pressure spool 24 supports a high pressure compressor section 28 and a high pressure turbine section 32. A combustor 30 is arranged between the high pressure compressor section 28 and the high pressure turbine section 32.

The core 14 includes a front architecture 36, having fixed structure, provided within the fan case 12 downstream from the fan 20. In one example, the front architecture 36 supports a stator vane assembly 38. However, it should be understood that the stator vane assembly 38 can be arranged along any section of the engine 10, and in one example in the low pressure compressor section 26. Although a high bypass engine is illustrated, the disclosed stator vane assembly 38 can be used in other engine configurations, including low bypass engines.

Figure 2B:
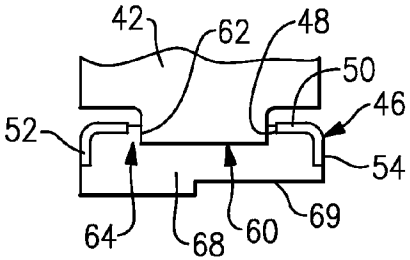
FIG. 2B is a cross-sectional view of the stator vane assembly shown in FIG. 2A taken along lines 2B-2B.
Figure 2C:
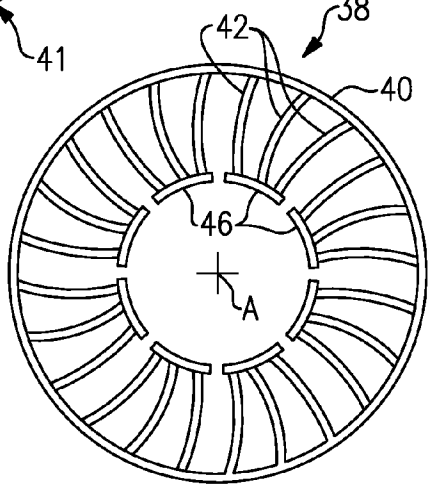
FIG. 2C is a schematic end view of the stator vane assembly.
Figure 2A:
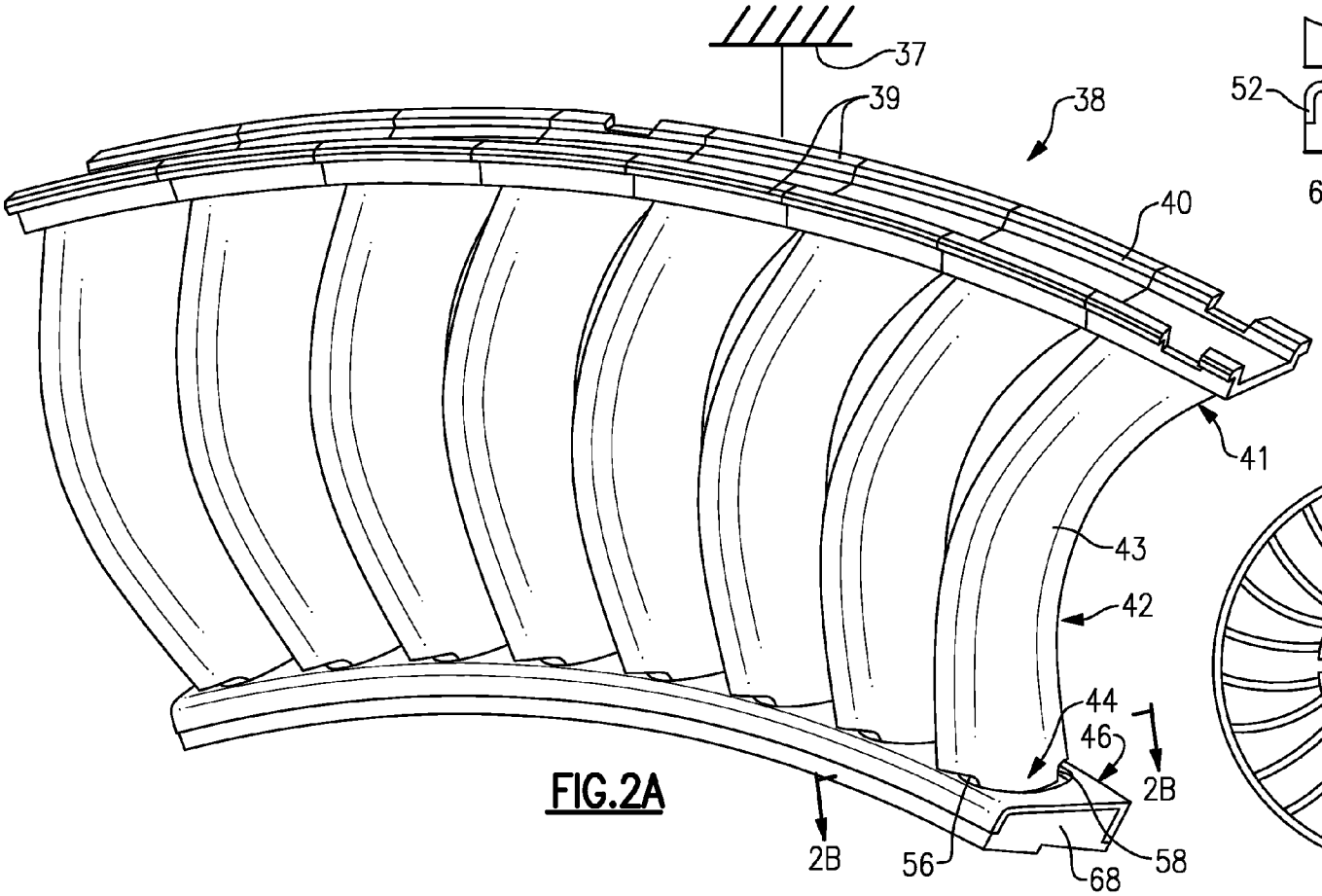
FIG. 2A is a perspective view of a stator vane array of a stator vane assembly for the gas turbine engine shown in FIG. 1.

Referring to FIG. 2A, the stator vane assembly 38 includes circumferential array of stator vanes 42. The vanes 42 are constructed from aluminum in one example. The vanes 42 are grouped in subassemblies to provide the stator vane assembly 38 and arranged about the axis A at a desired stage, as shown in FIG. 2C. Each subassembly includes an inner shroud segment 46, which is constructed from either cast aluminum or stamped sheet steel. In one example, 7 inner shroud segments 46 are provided circumferentially about the axis A. However, it should be understood that any number of inner shroud segments may be used at a given stage.

In the example, the vanes 42 include a discrete, outer shroud 40 integral with an outer end 41 of each vane 42. The outer shrouds 40 include hooks 39 that are supported by an outer case 37. An inner end 44 of each vane 42 is received in a corresponding aperture 48 of the inner shroud segment 46.

The vanes 42 provide an airfoil surface 43. The inner end 44 includes leading and trailing edge notches 56, 58 that provide a portion 60 at the inner end 44 that is received within the aperture 48. A portion 60 provides a perimeter 62 that is spaced from the aperture 48 to provide a gap 64, best shown in FIG. 2B. The vane 42 is spaced from and does not contact the inner shroud segment 46 directly.

Figures 3A, 3B:
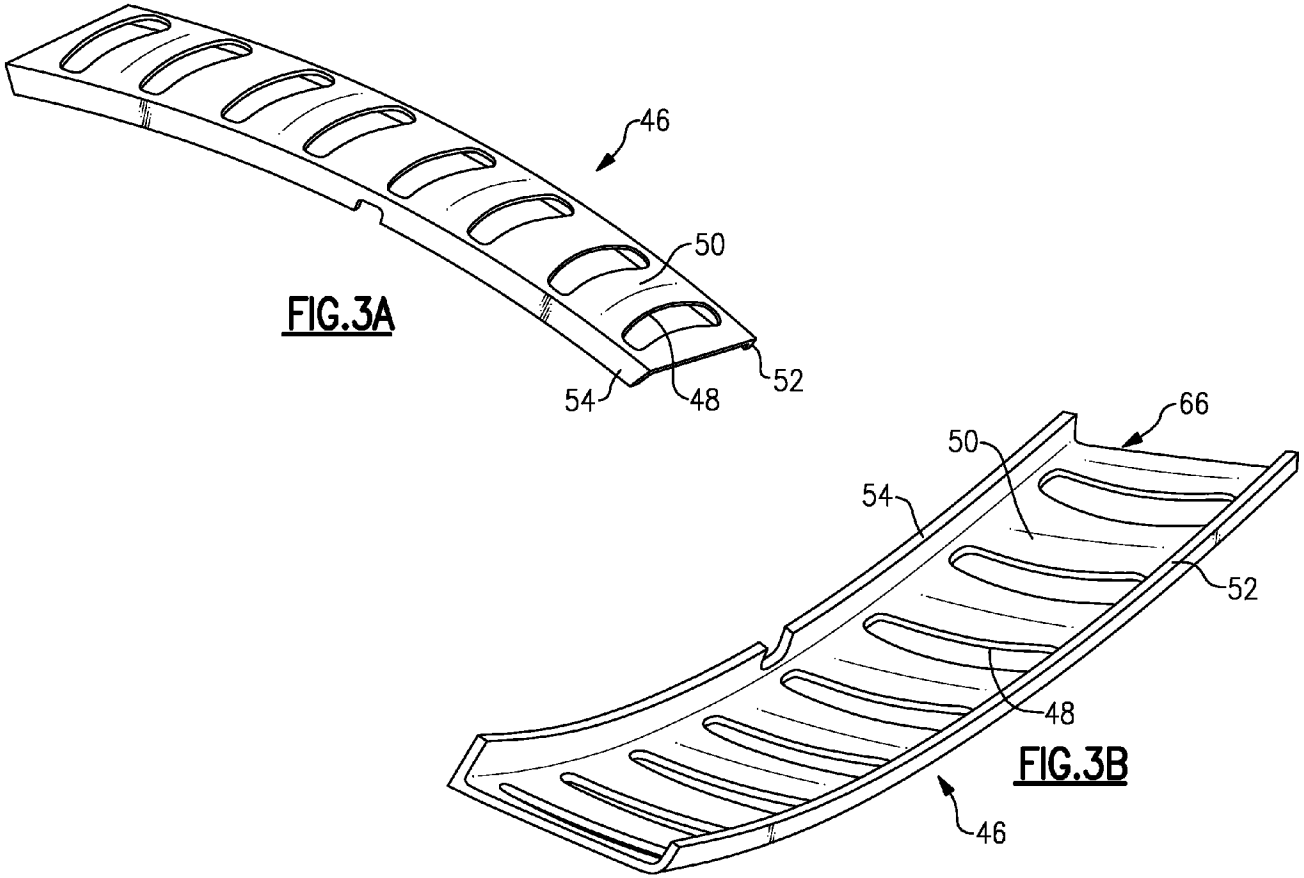
FIG. 3A is an outer perspective view of an example inner shroud.
FIG. 3B is an inner perspective view of the example inner shroud shown in FIG. 3A.

Referring to FIGS. 3A and 3B, the inner shroud 46 includes an arcuate wall 50 providing the apertures 48. First and second flanges 52, 54, on a concave side opposite the vanes 42, adjoin opposing axial ends of the wall 50 to provide a cavity 66. A flexible material 68 fills the gap 64 to adjoin the portion 60 to the inner shroud 46. The flexible material fills the cavity 66 in the example and extends proud of the first and second flanges 52, 54. In one example, the material 68 is an elastomeric material, and a silicone rubber, for example. The material 68 supports and vibrationally isolates and the inner ends 44 relative to the inner shroud 46. A rigid material, such as braze, would transmit undesirable vibration between the inner shroud and the vanes, which could not withstand such vibration if constructed from aluminum and stamped sheet steel.

Figure 4:
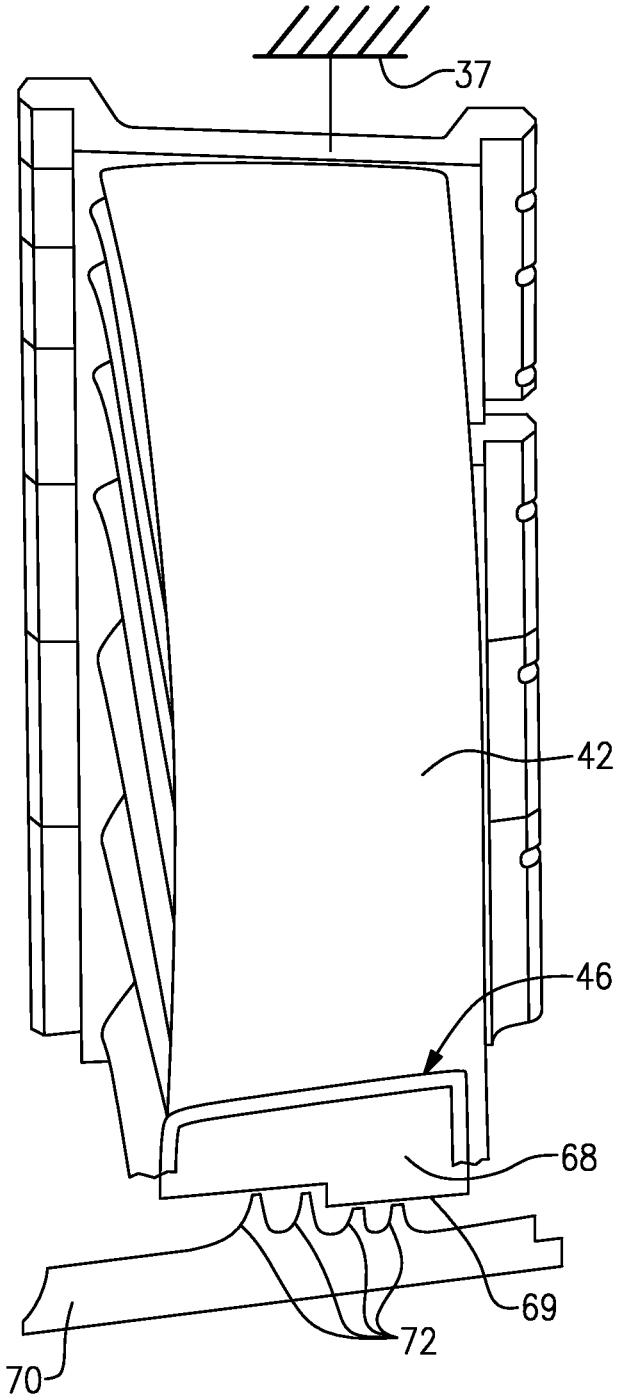
FIG. 4 is a side view of the stator vane assembly and a portion of a rotor.

Referring to FIG. 4, the material 68 provides an inner surface 69 that provides a seal land. In one example, the flexible material 68 extends radially inwardly and proud of the first and second flanges 52, 54. A rotor 70 that supports blades 74 (shown in FIG. 1) includes a sealing structure, such as knife edge seals 72 that engage the inner surface 69 to provide a seal between adjacent stages.

Although an example embodiment has been disclosed, a worker of ordinary skill in this art would recognize that certain modifications would come within the scope of the claims. For that reason, the following claims should be studied to determine their true scope and content.

What is claimed is:

1. A stator vane assembly comprising:

a vane that includes an inner end;

an inner shroud having a wall with first and second sides, the vane arranged at the first side, and an aperture in the wall receiving the inner end at the first side, a gap provided between the inner end and the aperture with the entire inner end spaced from the inner shroud; and a flexible material arranged in the gap and securing the inner end to the inner shroud, the same flexible material extending through the aperture to the second side, the flexible material having an inner surface opposite the vane providing a seal land.

2. The assembly according to claim 1, comprising a rotor including a sealing structure engaging the seal land.

3. The assembly according to claim 1, wherein the inner shroud is provided by a multiple circumferentially arranged discrete inner shroud segments, and a circumferential array of vanes each having inner ends supported by the inner shroud segments.

4. The assembly according to claim 3, wherein the inner shroud segments are provided by one of a cast aluminum structure or a stamped sheet steel structure.

5. The assembly according to claim 1, wherein the inner end includes at least one notch providing a portion received in the aperture in the inner shroud.

6. The assembly according to claim 1, wherein the flexible material is an elastomeric material.

7. The assembly according to claim 6, wherein the elastomeric material is a silicone rubber.

8. The assembly according to claim 1, wherein the inner shroud includes a wall providing the aperture receiving the inner end, and first and second spaced apart flanges adjoining the wall and providing a cavity, the cavity filled with the flexible material.

9. The assembly according to claim 8, wherein the flexible material extends radially inwardly and beyond the first and second flanges.

10. The assembly according to claim 1, wherein each vane includes an outer shroud integral with the vane.

11. The assembly according to claim 10, wherein the outer shroud includes hooks mounted in an outer case.

12. The assembly according to claim 2, wherein the rotor is provided in a compressor section.

13. A stator vane assembly comprising:

an array of aluminum vanes that each include an inner end;

an arcuate inner shroud segment having apertures that each receive a corresponding inner end, the inner shroud segment constructed from one of a cast aluminum and a stamped sheet steel; and a flexible material securing the inner ends to the inner shroud segment, the same flexible material extending through the aperture to a side opposite the vanes, the flexible material having an inner surface opposite the vane providing a seal land.

* * * * *